US006540581B2

(12) United States Patent
Kennedy

(10) Patent No.: US 6,540,581 B2
(45) Date of Patent: Apr. 1, 2003

(54) PUPPET CONSTRUCTION KIT AND METHOD OF MAKING A PERSONALIZED HAND OPERATED PUPPET

(76) Inventor: John Edward Kennedy, 3121 Castle Oak Ave., Orlando, FL (US) 32808

( * ) Notice: Subject to any disclaimer, the term of this patent is extended or adjusted under 35 U.S.C. 154(b) by 0 days.

(21) Appl. No.: 09/881,487

(22) Filed: Jun. 14, 2001

(65) Prior Publication Data

US 2002/0193044 A1 Dec. 19, 2002

(51) Int. Cl.[7] ..... A63H 3/14
(52) U.S. Cl. ..... 446/327; 446/85
(58) Field of Search ..... 446/327, 100, 446/97, 85

(56) References Cited

U.S. PATENT DOCUMENTS

| | | | | | |
|---|---|---|---|---|---|
| 2,729,023 | A | | 1/1956 | Lerner et al. | |
| 3,698,127 | A | | 10/1972 | Harp | |
| 3,942,283 | A | | 3/1976 | Rushion | |
| 4,010,570 | A | | 3/1977 | Kohler | |
| 4,054,006 | A | | 10/1977 | Estlund | |
| 4,173,842 | A | * | 11/1979 | Bahner | 446/391 |
| 4,207,704 | A | * | 6/1980 | Akiyama | 446/369 |
| 4,226,046 | A | * | 10/1980 | Delhome | 446/327 |
| 4,276,715 | A | * | 7/1981 | Rogers | 446/329 |
| 4,326,356 | A | * | 4/1982 | Mason | 446/73 |
| 4,504,240 | A | | 3/1985 | Thomas | |
| 4,838,827 | A | | 6/1989 | Schlaifer | |
| 4,938,515 | A | * | 7/1990 | Fazio | 2/21 |
| 4,944,710 | A | | 7/1990 | Sommers | |
| 4,964,832 | A | | 10/1990 | Bickoff | |
| 4,987,615 | A | * | 1/1991 | Massey | 2/206 |
| 5,080,626 | A | | 1/1992 | Maddi | |
| 5,171,151 | A | | 12/1992 | Barthold | |
| 5,322,465 | A | | 6/1994 | McGill | 446/100 |
| 5,348,510 | A | | 9/1994 | DuPont | 446/100 |
| 5,662,477 | A | | 9/1997 | Miles | 434/185 |
| D393,026 | S | * | 3/1998 | Ingram | D21/598 |
| 5,964,634 | A | | 10/1999 | Chang | 446/85 |
| 6,000,983 | A | * | 12/1999 | Pressman et al. | 446/118 |
| 6,010,387 | A | * | 1/2000 | Nemec et al. | 428/100 |
| 6,108,817 | A | * | 8/2000 | Kostelac | 446/338 |
| 6,234,858 | B1 | * | 5/2001 | Nix | 446/101 |

FOREIGN PATENT DOCUMENTS

| | | | | |
|---|---|---|---|---|
| CH | 588877 A | * | 6/1977 | A63H/03/36 |
| DE | 3343988 A1 | * | 6/1984 | A63H/03/14 |
| DE | 29912632 U1 | * | 10/1999 | A63H/03/00 |
| WO | WO 93/15490 | | 8/1993 | |

OTHER PUBLICATIONS

Harriet Gamble, Puppet Revolutionary: An interview with John E. Kennedy, Jun.–Summer 2000, Arts & Activities, pp. 38–40 44.*

Nick Barone Puppets, www.puppetbuilder.com, (c) 2000.*

Cedric Flower and Alan Fortney, Puppets: Methods and Materials, 1983, Davis Publications, pp. 8, 9, 29, 46, 47, and 99.*

* cited by examiner

*Primary Examiner*—Derris H. Banks
*Assistant Examiner*—Urszula M Cegielnik
(74) *Attorney, Agent, or Firm*—Jason A. Bernstein; Bernstein & Associates, PC

(57) ABSTRACT

A kit for making a personalized hands operated puppet, the kit comprising a sculptable block of material, such as a flexible foam, that may be readily cut and trimmed to form a head portion that can be manipulated by the hand of the puppeteer. The kit may further include a piece of fabric to be glued to the mouth opening to help stimulate the mouth of the puppet, a pair of eye balls to be inserted in eye sockets, an elongated sleeve, with simulated arms, for receiving the puppeteer's hand to operate the mouth motions of the puppet, and a pair of rigid wire members that may be used by the puppeteer's other hand to manipulate the arms of the puppet. A process for making the puppet is also disclosed.

18 Claims, 8 Drawing Sheets

PUPPET CONSTRUCTION KIT AND METHOD OF MAKING A PERSONALIZED HAND OPERATED PUPPET

FIELD OF THE INVENTION

The present invention is directed to the field of hands operated puppets, formed from a sculptable material, such as a flexible foam block, and to a method of making a personalized puppet.

BACKGROUND OF THE INVENTION

The present invention relates to a puppet construction kit, and to a method of fabricating the components thereof into a personalized puppet character that may reflect individual design features. At an early age many people experienced their first hand puppet fabricated from a white sock with a face marked thereon, but there was little input by the person operating the puppet. A search of the prior art revealed only a single patent that offered some creativity in making a hand puppet with limited personal touches. Such patent is U.S. Pat. No. 5,322,465, to McGill, which teaches a hand puppet kit to maximize creative play by the operator. The patent covers a hand puppet kit including a sock-like body member formed of a flexible material to have a hand receiving opening at one end thereof. The kit also includes a separate sheet of flexible material together with at least one pattern for creating a piece in a predetermined shape from the separate sheet of flexible material. With these features, the hand puppet kit further includes at least one portion of a hook and loop fastener to be secured to the piece.

The reaming developed prior art, as reflected in the following U.S. Patents, relate to a number of commercial hand puppets, without any or at best limited creativity by the operator or puppeteer, namely;

a) U.S. Pat. No. 5,080,626, to Maddi, is directed to a puppet of the type having a flexible elongated neck manipulated through movement from within by the puppeteer's forearm, and the puppet having depending legs adapted to serve as a rest or support for the forearm as well as the puppet's appearance.

b) U.S. Pat. No. 4,944,710, to Sommers, teaches the mouth construction for a puppet that is capable of being hand operated. The invention includes a pair of identical semi-rigid pieces having a lip region periphery having separate layers of fabric sewn to the pieces adjacent the lip periphery and one of the fabric layers is slit and pulled over the periphery to enclose the edge. The pieces are sewn together to define a hinge, and the assembly is mounted upon plates within a puppet mouth opening.

c) U.S. Pat. No. 4,504,240, to Thomas, relates to a hand puppet in which a plurality of different facial components can be removably attached to a head portion to produce different characters, such as monsters, funny looking characters, science fiction characters, etc. The hand puppet has a relatively rigid head portions, and the facial components can be attached anywhere on the head portion, and in any orientation relative to the head portion. A sleeve depends from the head portion, and has an opening at its distal end, and into which an operator's hand can be inserted to support the puppet. The sleeve is preferably formed of fabric which depicts an outer garment for the puppet and the sleeve has a pocket for storing the detachable facial components. Further, the sleeve is designed so that when the pocket is closed, it is basically hidden from view. Thus, the detachable facial components that are not being used to form the puppet's face are stored in a way which does not detract from the appearance of the puppet, and yet makes them readily accessible for changing the puppet's face.

d) U.S. Pat. No. 4,054,006, to Estlund, is directed to a puppet having a head from which a collar-like element extends downwardly below the mouth area for the receipt of the operator's arm. The mouth of the head is manipulated by one hand of the operator to simulate talking, biting, turning and the like. The head has hard, bulging eyes and a soft nose which are secured above the mouth area. The head and collar element are made of fabric material which may be of any type, the one herein illustrated is a woven cloth having long strands of fibers simulating hair over the outside thereof. Below the mouth area a pair of flexible extending arms are attached to opposite sides of the collar at the base of the head. Each arm is made of a cloth material which is doubled over and stitched along the bottom edge leaving an opening in which a rod is slidably secured. The rods have rubber tips on the inner and outer ends which require a substantial force for removal. The rods and arms are operated by one hand while the mouth and head of the puppet are actuated by the other hand of the operator.

e) U.S. Pat. No. 4,010,570, to Kohler, teaches a puppet comprising a head and a costume, the head comprising a container filled with a resilient foam material squeezed therein, the material having a slitted portion extending into the container from its opening, the slitted portion providing a finger-receiving receptacle for manipulation of the head by a finger, and the costume being in the form of a mitten for receiving a hand, the head and costume being in assembled relation when a hand is inserted into the mitten and a finger of the hand is inserted into the slitted portion of the head.

f) U.S. Pat. No. 3,942,283, to Rushton, relates to a hand puppet, resembling a stuffed animal has a pocket extending therein into which the head of a manipulator is inserted. The pocket is configured to extend into the legs and head of the animal so that the legs and head may be moved by the fingers of the manipulator. Behind the pocket, there is a cavity which is filled with polyurethane foam or the like so that the back portion of the animal retains its shape as the animal is manipulated.

g) U.S. Pat. No. 3,698,127, to Harp, is directed to a puppet with a substantially spherical head having a movable mouth which is operated by a pulling string. The string is attached to the lower jaw if the lower jaw is to be moved or it is attached to the upper part of the head if the upper part of the mouth is to move with respect to the lower part. The head is supported upright on a rod extending downward therefrom so that the lower end of the rod may be gripped to hold the puppet upright or said lower end maybe set into a support. The head may be rotated with respect to the cup-shaped member by rotating the rod and suitable arms may be attached to the cup-shaped member so that this member appears as the upper part of the puppet body.

The prior art is significantly devoid of providing the inexperienced puppeteer with the opportunity to create a unique puppet with the personal characteristics and design features of the puppeteer. The present invention, with a kit of components to make a puppet, and by a step by step process, gives the puppeteer the freedom to develop such unique puppet. The manner by which the present invention achieves the goals hereof will become apparent in the description which follows, particularly when considered in conjunction with the accompanying drawings.

SUMMARY OF THE INVENTION

The present invention relates to a kit of components for making a personalized hands operated puppet, and to a step by step process for making same. The method, in a first embodiment, comprises the steps of selecting a generally rectangular block of sculptable material, such as a flexible foam, and tracing a head portion of the block by a template pattern. Thereafter, the block is cut and trimmed to produce a head portion having a pair of sections that are foldable upon one another to simulate a head to be activated by the movement of the operator's hand. To simulate features of the puppet, a fabric mouth lining is provided, including a simulated tongue. Included with the kit may be a pair of eye balls to be inserted into complementary carved eye sockets, an elongated sleeve member to be glued to the head portion, where the sleeve member includes a pair of simulated arm extensions, and a pair of rigid wire members for attaching to the arms for manipulating the arms. As an alternative to the generally rectangular block of the first embodiment, the starting sculptable material may comprise a pre-cut foam block having a slot dividing the block into two sections, joined by a thin flexible web. A further alternative, or third embodiment, may comprise an elongated block of foam and a second smaller block to be secured to the elongated block.

Accordingly, an object of the present invention is to provide a convenient means to make a personalized hands operated puppet by an unskilled person.

A further object hereof is the provision of a kit of components that one may use with typical household tools to make a personalized puppet that reflects the characteristics of the intended puppeteer.

These and other objects of the invention will become more apparent in the description which follows, particularly when read in conjunction with the accompanying drawings.

BRIEF DESCRIPTION OF DRAWINGS

The several Figures illustrate sequentially the various steps in making a personalized, hands operated puppet, where the respective Figures show the following:

FIG. 4B shows the preliminary folded block provided with finger and thumb slots.

DETAILED DESCRIPTION OF PREFERRED EMBODIMENT

Figure 1:
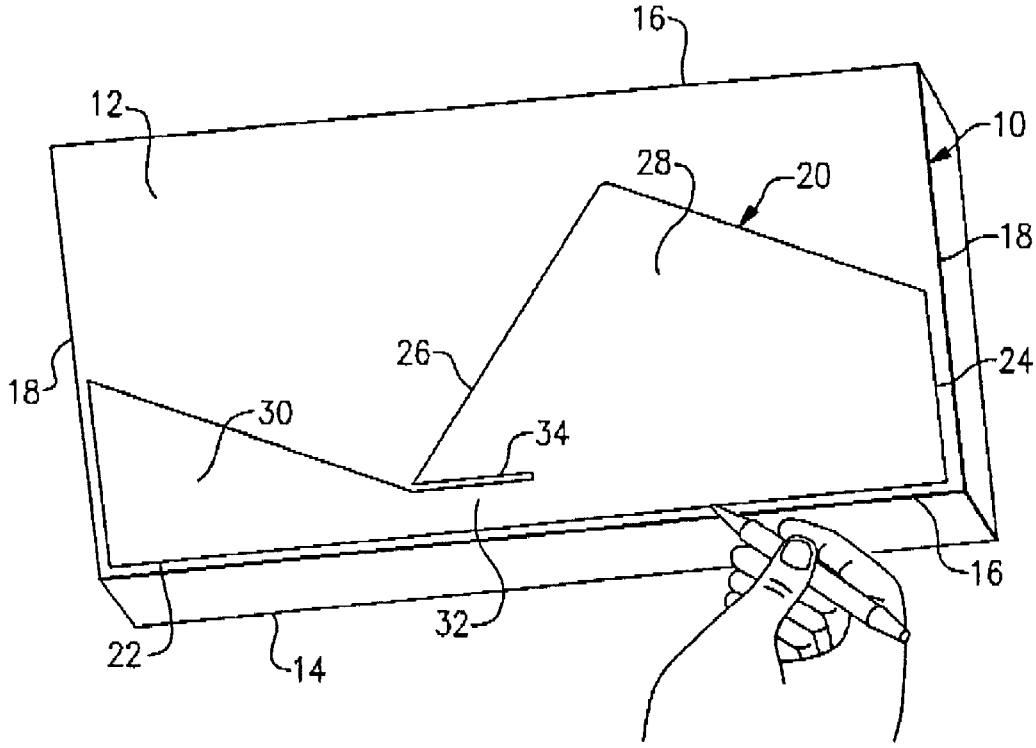
FIG. 1 is a perspective view of a block of sculptable material, such as a flexible foam, and a template pattern for tracing along a major face of the block, where the tracing begins the method for a first embodiment of the present invention.

The present invention is directed to a puppet construction kit of components for making a personalized puppet, and to the various steps in producing said puppet for hand operation by the puppeteer. The invention will now be described with regard to the several Figures, such as by the sequence of steps to produce same, where like reference numerals represent like components or features throughout the various views.

Figure 2:
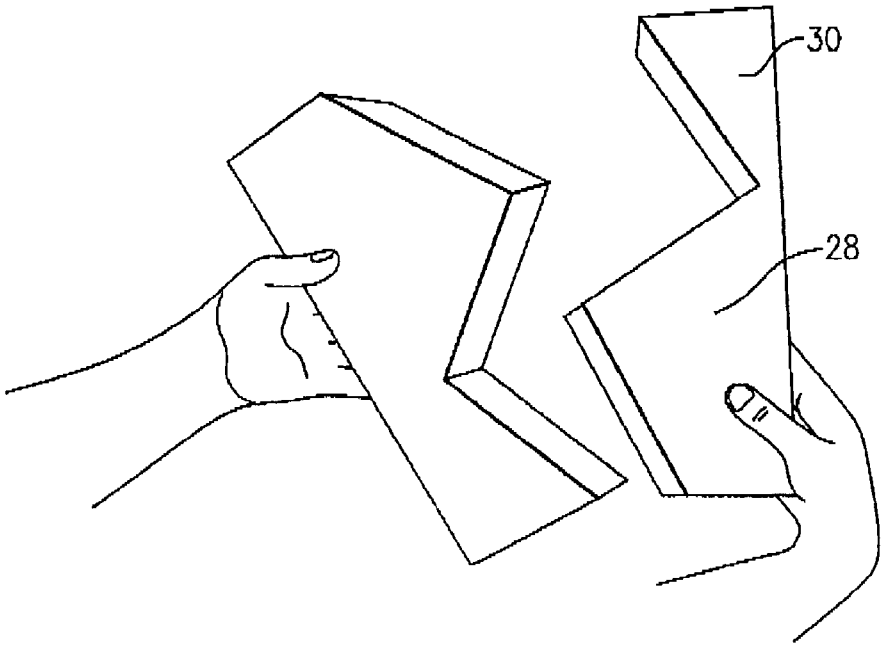
FIG. 2 is a perspective view of the cut block of FIG. 1 showing major and minor block segments, where each said segment shows a flat base wall and a common upper Z-shaped wall.

The starting materials for a first embodiment for making the personalized puppet of the present invention are illustrated in FIG. 1. The kit of components includes a block 10 of sculptable material, such as a flexible foam, which is generally rectangular in shape, with front and rear faces 12, 14, respectively, a pair of parallel long sides 16, and a pair of parallel short sides 18. While dimensions may vary, a preferred size is about 6 by 12 inches. The depth of thickness thereof, as will be apparent hereafter, is at least equal to the breadth of the operator or puppeteer's hand, i.e., about 4 to 5 inches. To cut the head portion out of the block 10, a template pattern 20 for tracing the head portion is provided. The template pattern 20 consists of a planar sheet having a lower continuous edge 22 of a size approximately equal to said long side, a pair of parallel side edges 24, and a Z-shaped upper edge 26. This design results in a pair of head sections 28, 30 joined by a thin section 32, where said thin section is further defined by the lateral slot 34 undercut into the larger head section 28. With the tracing marked on the block 10, the head sections 28, 30 may be cut out to reveal one or two head integral head sections 28, 30, see FIG. 2. With a preferred template pattern 20, two mirror image head portions may be cut from a single said block 10.

Figure 3:
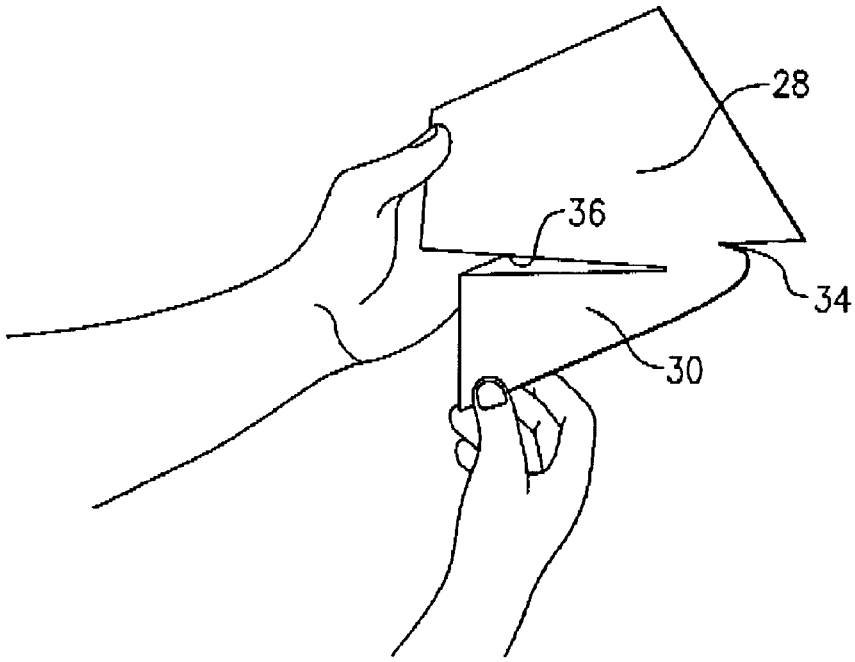
FIG. 3 is a perspective view showing the beginning formation of a puppet head, where the minor block segment has been folded essentially 189° to a position where portions of said flat base wall are contiguous to one another.
Figure 4:
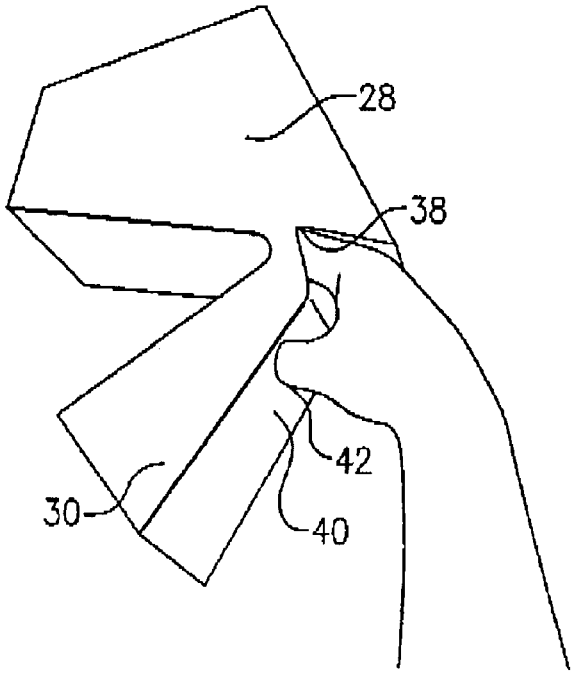
FIG. 4 is a perspective view of the folded block segments, where the two segments have been provided with slots for receiving the operator's fingers and thumb.

FIG. 3 illustrates the first step in forming the cut block into a puppet head. Specifically, the smaller head section 30 is folded at the thin section 32 and slot 34 about 180° to form a mouth-opening 36. With the respective head sections so folded, the rear of the larger head section 28, as an extension of the slot 34, is provided with a lateral slot 38, where the breadth and depth of the slot is of a size to slidably receive the four fingers of the operator, see FIG. 4. Additionally, the rear 40 of the smaller head section 30 includes an opening 42 for receipt of the operator's thumb in an operative mode. Thus, by movement of the operator's fingers and thumb, the operator can simulate a moving mouth. Further, by holding the head sections as shown in FIG. 4, it is now possible to finish the facial designs features.

Figure 4A:
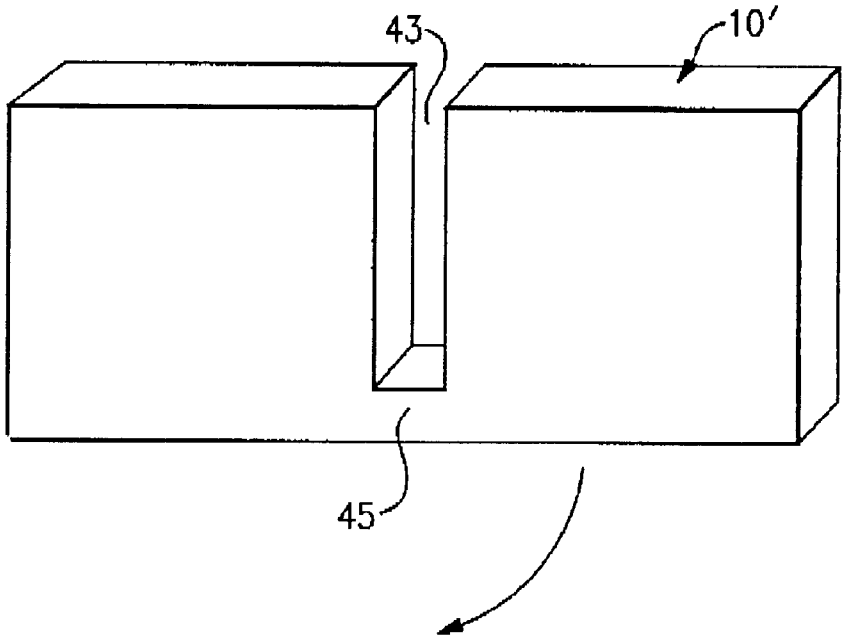
FIGS. 4A and 4B are perspective views of a second embodiment for a starting block for making the puppet according to this invention, where
Figure 4B:
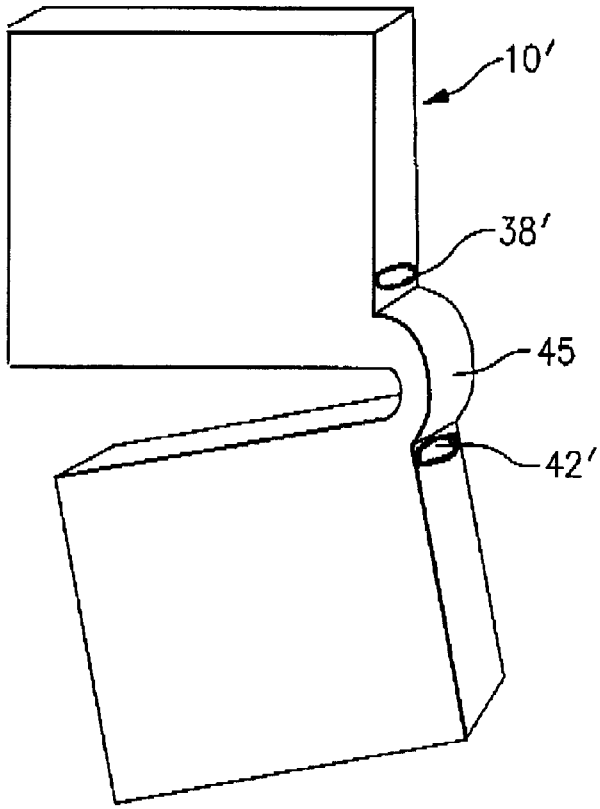
Figure 4C:
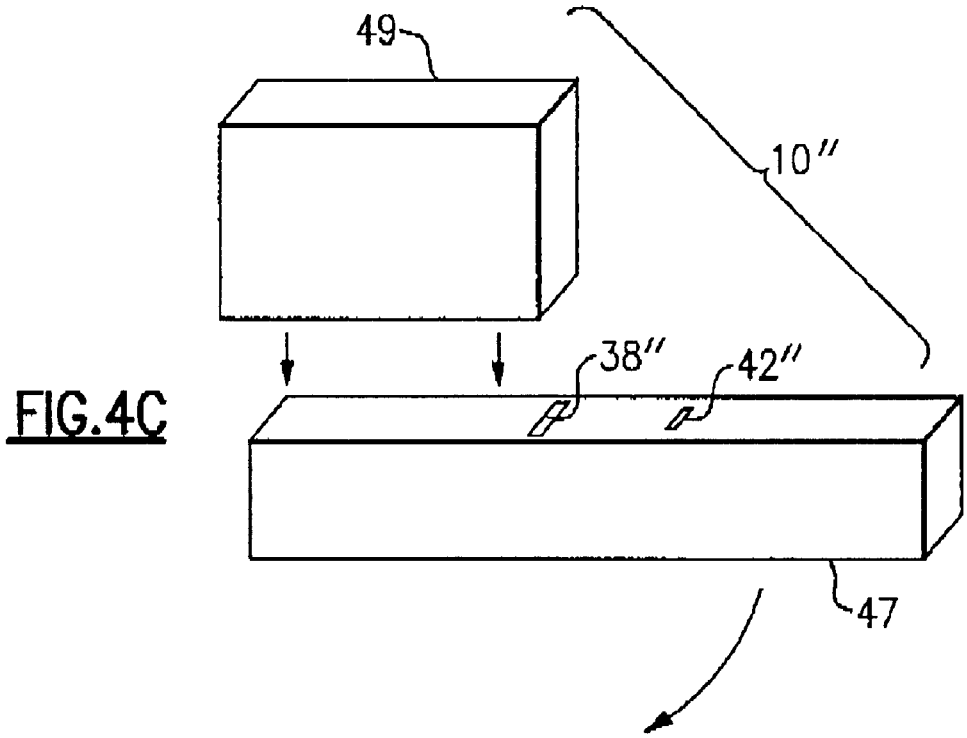
FIGS. 4C and 4D are perspective views of a third embodiment for a two-piece starting block for making the puppet of this invention, where the finger and thumb slots have been pre-cut.
Figure 4D:
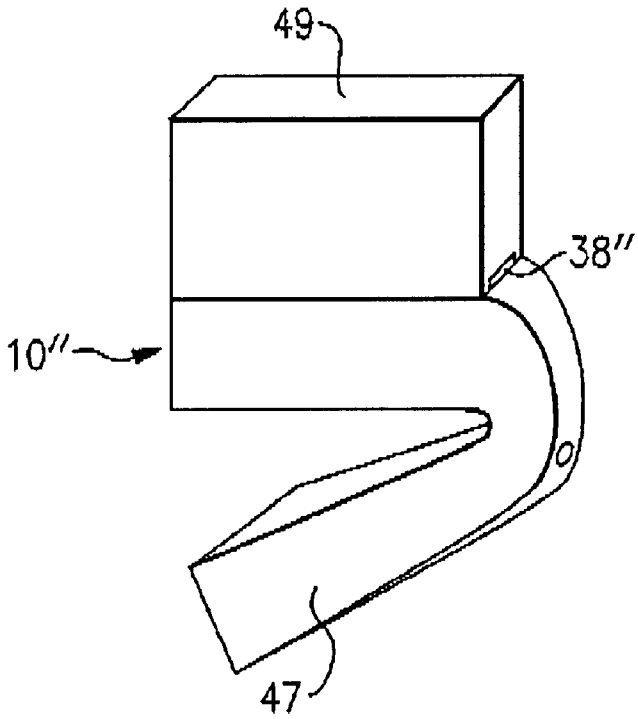

FIG. 4A illustrates a second embodiment for the starting block 10' of sculptable material, such as foam, for the puppet making step of this invention, where the block has been provided with central slot 43 terminating in a thin flexible section 45, see also FIG. 4B. Additionally, the block, as best seen in FIG. 4B, has been provided with a finger slot 38' and thumb opening 42', the purpose of which has been noted above. Alternatively, a third embodiment for the starting material is illustrated in FIGS. 4C and 4D. In this embodiment, the starting block 10" may comprise a two-piece member consisting of an elongated block section 47, pre-cut with a finger slot 38" and thumb opening 42" for the reasons discussed above. The second member 49 is a smaller member to be glued or otherwise secured to the elongated block section 47 as shown in FIG. 4C. In all cases, the sculptable block 10, 10', 10" may be readily bent or formed to allow the operator to place his hand into the finger slot and thumb opening for designing and sculpting the puppet according to the teachings of this invention.

Figure 5:
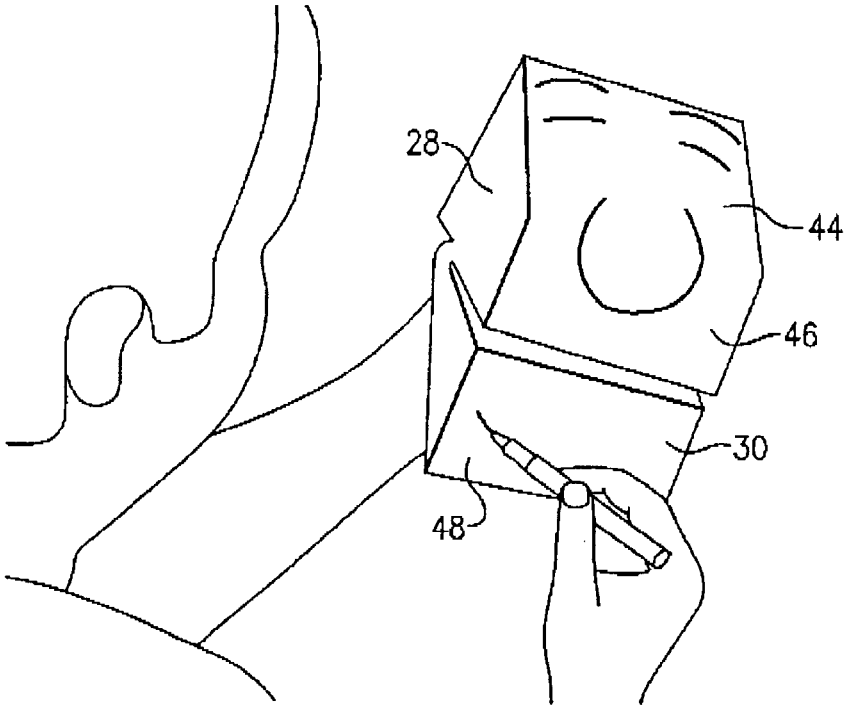
FIG. 5 is a perspective view showing some initial tracing of facial features on the exposed faces of the block segments, where personal touches for the puppet begin to develop.
Figure 6:
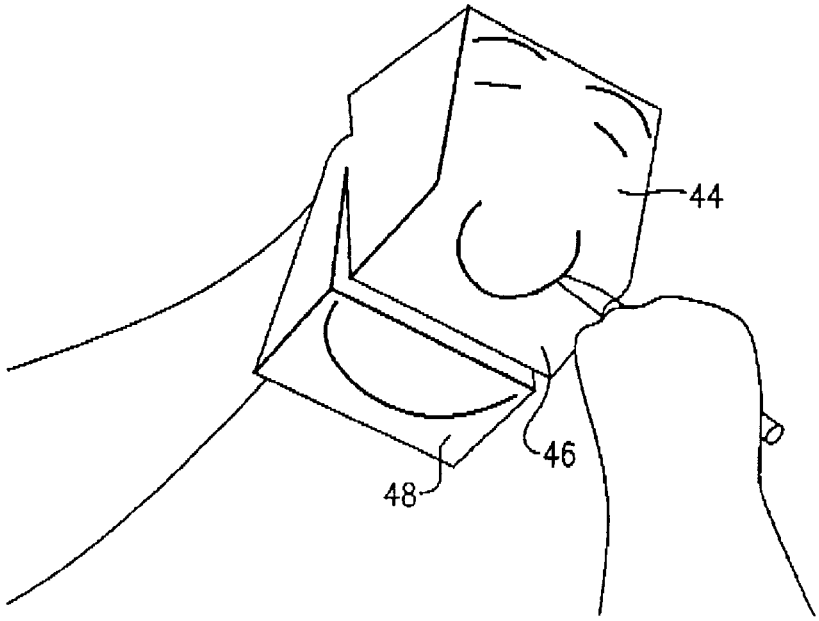
FIG. 6 is a perspective view showing a first step in cutting into the block segments about the facial tracings of FIG. 5.
Figure 7:
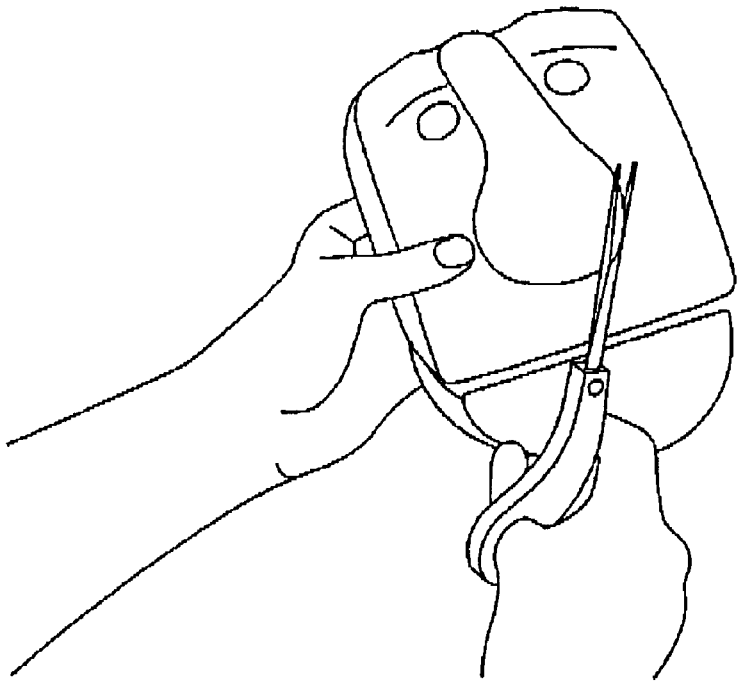
FIG. 7 is a perspective view showing additional cutting of the block segments and the development of a shaped head for the puppet.
Figure 8:
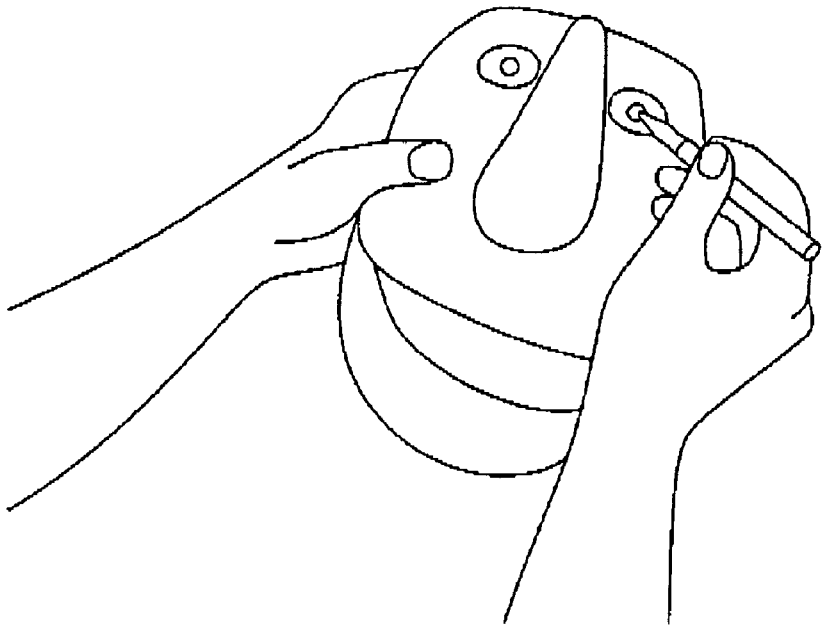
FIG. 8 is a perspective view of the cut and trimmed puppet head, where a step of the cutting and trimming is to provide eye sockets for receiving eye balls and the painting thereof.

FIGS. 5 to 11, for the three embodiments for designing and personalizing a puppet according to this invention. FIG. 5, for example, illustrates the three surfaces for the embodiment of FIGS. 1 to 4 on which facial tracings and shaping are performed. Though the further description will be limited to the design and shaping of the first embodiment, it will be understood that essentially the same steps are followed for the second and third embodiments. Returning now to the first embodiment, the larger head section 28 has an upper face section 44 and a lower face section 46, while the smaller head section 30 has a single face section 48, where the latter represents the lip of the puppet. Having identified the three surfaces, one is now ready to draw or trace the facial features, such as the nose, lip, and eyes, including eye sockets. This is where the unique or personalized characteristics of the puppet are developed. Once drawn, the respective head sections may be carved and shaped, such as by a scissors, see FIGS. 6 and 7. FIG. 7 shows some final trimming touches to the puppet's head.

Providing eye sockets is part of the carving and trimming operation. Into the sockets a pair of eye balls, forming a part of the kit of components, are inserted, glued and painted, note FIG. 8.

Figure 9:
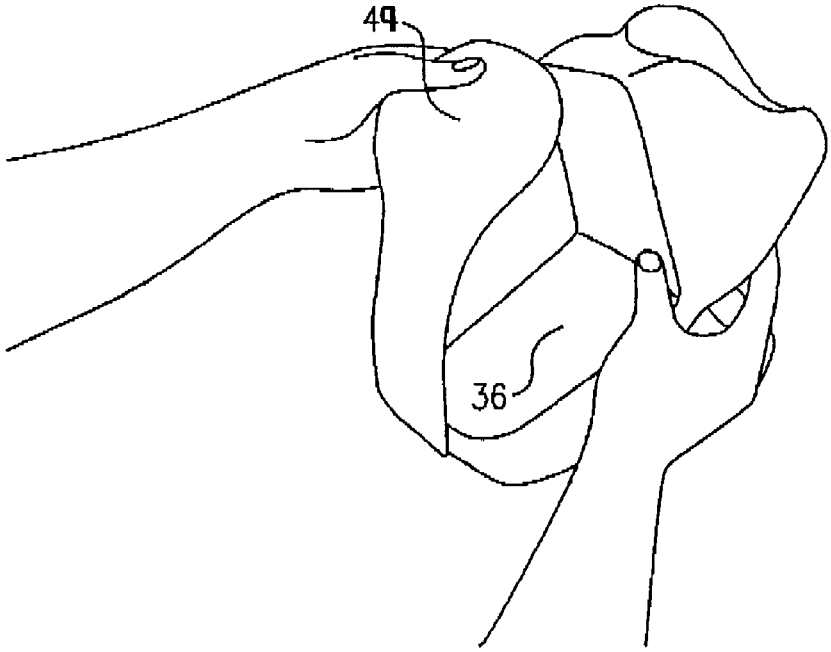
FIG. 9 is a perspective view of the partially flexed head, or major and minor block segments, and the application of a mouth liner in the form of a fabric.
Figure 10:
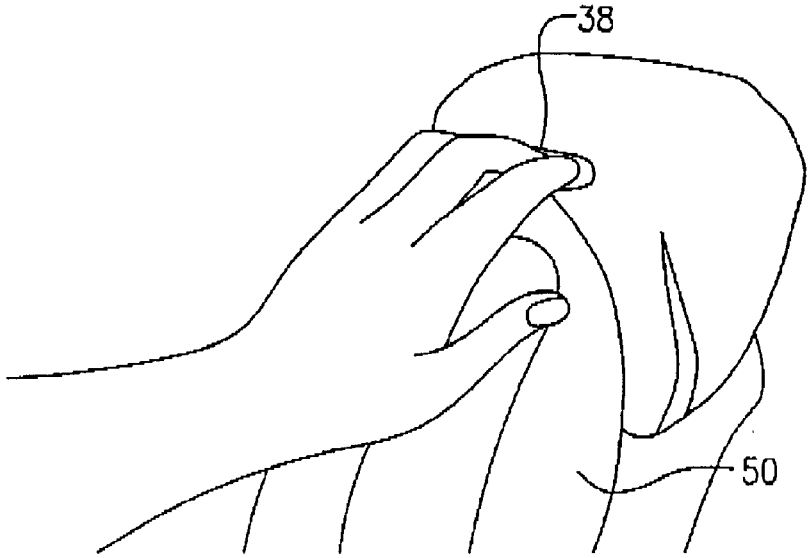
FIG. 10 is a rear perspective view of the flexed head showing the attachment of a sleeve member to the finger and thumb slots.
Figure 11:
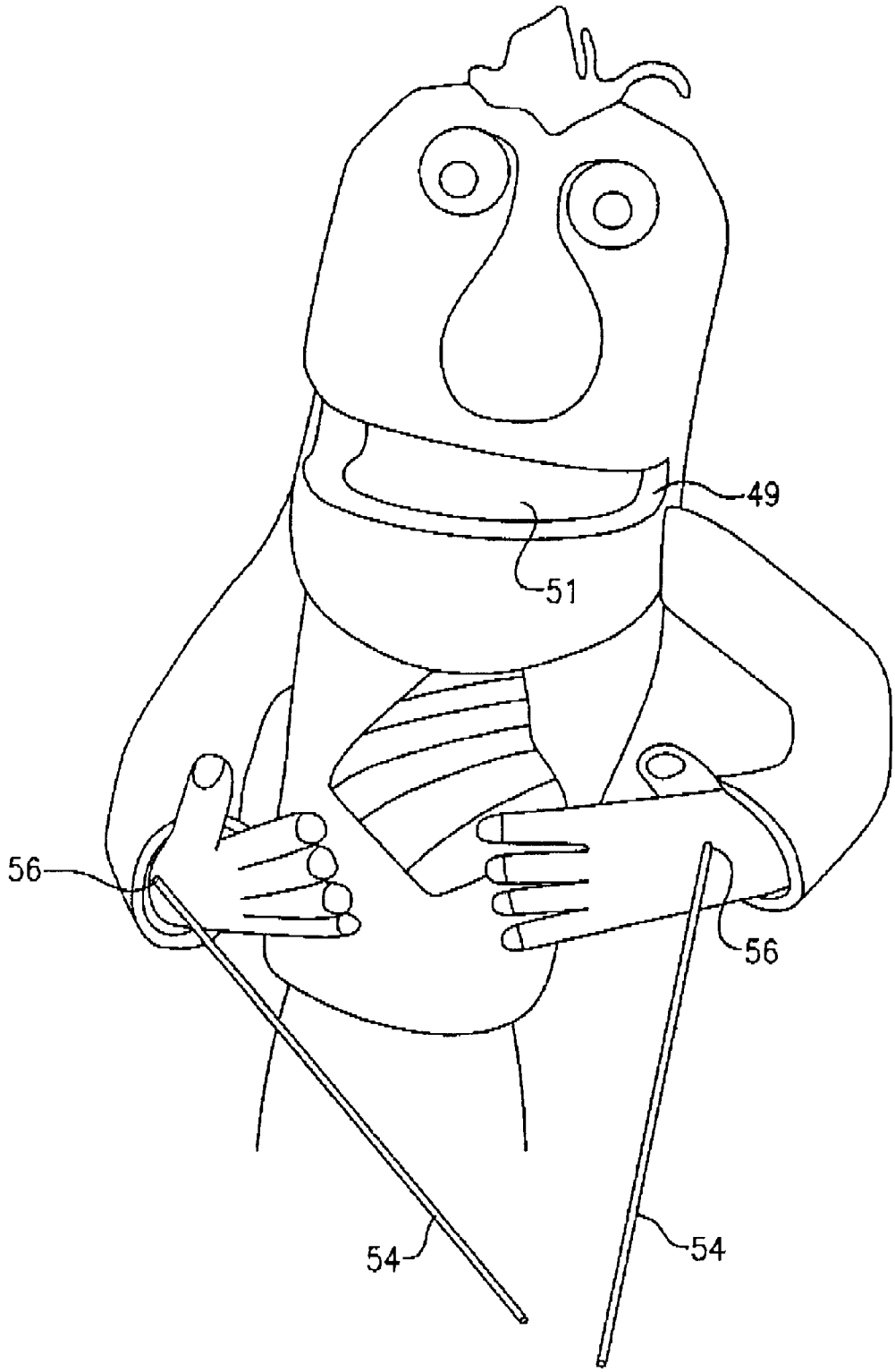
FIG. 11 is a perspective view of a finished hands operated puppet made by the method of the present invention, where the puppet further includes a pair of rigid wires extending from the wrists of the puppet to allow manipulation of the hands of the puppet.

FIGS. 9 to 11 illustrate the final steps in making the personalized puppet of the present invention. To simulate the mouth of the puppet, a piece of fabric 49, preferably a dark color and of a size about equal to the block's long side and depth, is glued and placed in the mouth opening 36, see FIG. 9, followed by trimming the edges. As an added touch, a smaller piece of fabric 51, such as pink or comparable skin color, may be glued inside the mouth to represent the tongue of the puppet, see FIG. 11. To operate the puppet, an elongated fabric sleeve 50, with a pair of simulated arms 52 is provided. The sleeve 50 may be glued into the lateral finger slot 38 and thumb opening 42, see FIG. 10, To further personalize the puppet, hair may be added to the head of the puppet, and dress features may be included on the sleeve 50. Thereafter, as best seen in FIG. 11, a pair of rigid wires 54 may be secured to the respective wrists 56 of the puppet, by means known in the art, to allow manipulation of the arms by the operator's other hand. Thus, the final product is a hands operated puppet, where a first hand is inserted into the sleeve 50 to manipulate the head, and the other hand may be used to move the arms to help animate the puppet. Though not illustrated as a separate item, the kit of components for this invention may include a pair of sculptable or flexible hands, see FIG. 11.

It is recognized that changes, variations and modifications may be made to the puppet components and process of utilizing same in making a personalized puppet, particularly by those skilled in the art, without departing from the spirit and scope of the invention. Accordingly, no limitation is intended to be imposed thereon except as set forth in the accompanying claims. All patents, applications and publications referred to herein are in incorporated by reference in their entirety.

What is claimed is:

1. A method of fabricating a personalized, hands operated puppet, said method comprising the steps of:

a) selecting a generally rectangular block of a sculptable material, where said block has front and rear faces, each defined by a pair of parallel long sides, a pair of parallel short sides, and a thickness greater than the breadth of the operator's hand;

b) tracing a Z-shaped pattern from a said short side to the opposite said short side, where a first trace is angled upwardly from a first said side toward a midpoint in proximity to a first said long side, a second trace downwardly from said midpoint to an internal location in proximity to said second long side, and a third trace upwardly from said internal location to a midpoint along said second side wall;

c) cutting through said block along said traces to provide essentially two equal pieces of sculptable material;

d) undercutting said block from said internal location parallel to said long walls and in a direction toward said first side wall;

e) folding the block portion defined by the third trace upon said second long side, to define the lower jaw and head portions for the puppet;

f) cutting a slot in said head portion as an extension of said undercutting, where said slot is of a size to receive the operator's fingers;

g) cutting an opening in said lower jaw portion to receive the operator's thumb, whereby movement of the fingers and thumb will simulate the opening and closing of said lower jaw;

h) tracing facial features along exposed faces of said head portion;

i) personalizing the character of the head and jaw portions by removing excess sculptable material about said facial features to reveal a shaped head; and, j) applying a sheet of fabric to said block portion that defines the mouth to simulate the inside of the mouth of said puppet.

2. The method of claim 1, after removing excess sculptable material about said facial features, including the further step of providing a pair of sockets for receiving eyes.

3. The method of claim 2, including a final step of selecting a fabric sleeve to receive the operator's arm, said sleeve adjacent one end being provided with a pair of elongated extensions to simulate the arms of the puppet, and gluing the end of said sleeve into said head slot and thumb opening.

4. The method of claim 3, including the step of attaching rigid wire supports to said simulated arms for manipulation by the second hand of the operator.

5. A kit of components for making a personalized hand operated puppet, said kit comprising:

a) a generally rectangular block of sculptable material defined by front and rear faces, a pair of long sides and a pair of short sides, with a thickness greater than the breadth of the operator's hand;

b) a template pattern having a flat bottom edge, parallel edges, and an upper Z-shaped edge to define first and second portions connected by a foldable thin wall section;

c) an ink marker to trace said template pattern onto said front face, and for tracing facial features onto said sculptable material;

d) a pair of eye balls to simulate the eyes of the puppet; and e) a generally rectangular piece of fabric of a dimension equal to said block thickness and said long side.

6. The kit of components of claim 5, further comprising a fabric sleeve having a pair of simulated arms extending therefrom, a pair of simulated hands, and a pair of rigid wire members for attaching to said simulated arms for manipulating same.

7. A method of fabricating a personalized, hands operated puppet, said method comprising the steps of:

a) selecting a generally rectangular block of a flexible foam, where said block has front and rear faces, each defined by a pair of parallel long sides, a pair of parallel short sides, and a thickness greater than the breadth of the operator's hand;

b) tracing a Z-shaped pattern on said front face from a said short side to the opposite said short side, where a first trace is angled upwardly from a first said side toward a midpoint in proximity to a first said long side, a second trace downwardly from said midpoint to an internal location in proximity to said second long side, and a third trace upwardly from said internal location to a midpoint along said second side wall;

c) cutting through said block along said traces to provide essentially two mirror image pieces of foam d) undercutting said block from said internal location parallel to said long walls and in a direction toward said first side wall;

e) folding the block portion defined by the third trace upon said second long side, to define the lower jaw and head portions for the puppet;

f) cutting a slot in said head portion as an extension of said undercutting, where said slot is of a size to receive the operator's fingers;

g) cutting an opening in said lower jaw portion to receive the operator's thumb, whereby engagement and movement of said fingers and thumb will simulate the opening and closing of said lower jaw;

h) tracing facial features along exposed faces of said head portion;

i) personalizing the character of the head and jaw portions by removing excess foam about said facial features to reveal a shaped head;

j) applying a sheet of fabric to said block portion that defines the mouth to simulate the inside of the mouth of said puppet;

k) adhering a fabric sleeve member to said head portion, where said sleeve member includes a pair of extensions to simulate arms, each said arm terminating in hand and wrist; and, l) attaching a rigid wire member to said wrist, whereby said wire members may be used to manipulate said arms.

8. The method of claim 7, including the further step of applying a lighter and smaller piece of fabric to said mouth fabric to simulate the tongue of the puppet.

9. A kit of components for making a personalized hand operated puppet, said kit comprising:

a) a generally rectangular block of sculptable material defined by front and rear faces, a pair of long sides and a pair of short sides, with a thickness greater than the breadth of the operator's hand;

b) a template pattern having a flat bottom edge, parallel side edges, and an upper Z-shaped edge to define first and second portions connected by a foldable thin wall section;

c) a pair of eye balls to simulate the eyes of the puppet; and, d) a piece of fabric.

10. The kit of components of claim 5, further comprising a fabric sleeve having a pair of simulated arms extending therefrom, a pair of simulated hands, and a pair of rigid wire members for attaching to said simulated arms for manipulating same.

11. A kit of components for making a personalized hand operated puppet, said kit comprising:

a) a generally rectangular block of sculptable material defined by front and rear faces, a pair of long sides and a pair of short sides, with a thickness greater than the breadth of the operator's hand;

b) a template pattern having a flat bottom edge, parallel side edges, and an upper Z-shaped edge to define first and second portions connected by a foldable thin wall section;

c) an ink marker to trace said template pattern onto said front face, and for tracing facial features onto said sculptable material; and, d) a piece of fabric.

12. The kit of components of claim 5, further comprising a fabric sleeve having a pair of simulated arms extending therefrom, a pair of simulated hands, and a pair of rigid wire members for attaching to said simulated arms for manipulating same.

13. A kit of components for making a personalized hand operated puppet, said kit comprising:

a) a generally rectangular block of sculptable material defined by front and rear faces, a pair of long sides and a pair of short sides, with a thickness greater than the breadth of the operator's hand;

b) a template pattern having a flat bottom edge, parallel side edges, and an upper Z-shaped edge to define first and second portions connected by a foldable thin wall section;

c) an ink marker to trace said template pattern onto said front face, and for tracing facial features onto said sculptable material; and, d) a pair of eye balls to simulate the eyes of the puppet.

14. The kit of components of claim 5, further comprising a fabric sleeve having a pair of simulated arms extending therefrom, a pair of simulated hands, and a pair of rigid wire members for attaching to said simulated arms for manipulating same.

15. A personalized, hand operated puppet constructed by a method, comprising the steps of:

a) selecting a block of a sculptable material, where said block has front and rear faces, each defined by a pair of parallel long sides, a pair of parallel short sides, and a thickness greater than the breadth of the operator's hand;

b) cutting a Z-shaped pattern from a said short side to the opposite said short side, where a first cut is made angled upwardly from a first said side toward a midpoint in proximity to a first said long side, a second cut is made downwardly from said midpoint to an internal location in proximity to said second long side, and a third cut is made upwardly from said internal location to a midpoint along said second side wall, so as to provide two pieces of sculptable material;

c) undercutting said block from said internal location parallel to said long walls and in a direction toward said first side wall;

d) folding the block portion defined by the third cut upon said second long side, to define the lower jaw and head portions for the puppet;

e) cutting a slot in said head portion as an extension of said undercutting, where said slot is generally of a size to receive the operator's fingers;

f) cutting an opening in said lower jaw portion to receive the operator's thumb, whereby movement of the fingers and thumb will simulate the opening and closing of said lower jaw;

g) personalizing the character of the head and jaw portions by removing excess sculptable material from said block; and, h) applying a sheet of fabric to said block portion that defines the mouth to simulate the inside of the mouth of said puppet.

16. The puppet of claim 15, further including a step i) providing a pair of sockets for receiving eyes.

17. The method of claim 16, including a step j) selecting a fabric sleeve to receive the operator's arm, said sleeve adjacent one end being provided with a pair of elongated extensions to simulate the arms of the puppet, and gluing the end of said sleeve into said head slot and thumb opening.

18. The method of claim 17, further including a step k) attaching rigid wire supports to said simulated arms for manipulation by the second hand of the operator.

* * * * *